US005537802A

United States Patent [19]

Orndorff

[11] Patent Number: 5,537,802

[45] Date of Patent: Jul. 23, 1996

[54] PACKAGING APPARATUS AND METHOD FOR PREVENTING SEPARATION OF PACKAGE SEALS

[75] Inventor: Gary J. Orndorff, Sunman, Ind.

[73] Assignee: The Procter & Gamble Company, Cincinnati, Ohio

[21] Appl. No.: 346,115

[22] Filed: Nov. 29, 1994

[51] Int. Cl.[6] ..... B65B 9/00

[52] U.S. Cl. ..... 53/450; 53/579; 53/550

[58] Field of Search ..... 53/450, 451, 579, 53/550, 551, 553, 374.3, 374.4

[56] References Cited

U.S. PATENT DOCUMENTS

| | | | |
|---|---|---|---|
| Re. 33,467 | 12/1990 | Steck et al. | 53/451 |
| 3,035,381 | 5/1962 | Hosso | 53/182 |
| 3,278,358 | 10/1966 | Rosewicz et al. | 156/306 |
| 3,585,623 | 6/1971 | Laukaitis | 340/256 |
| 3,640,051 | 2/1972 | Cloud, Jr. | 53/178 |
| 3,748,207 | 7/1973 | Campbell et al. | 156/359 |
| 3,959,952 | 6/1976 | Deutschlander | 53/373 |
| 4,002,519 | 1/1977 | Moseley et al. | 156/204 |
| 4,262,473 | 4/1981 | Brooke | 53/451 |
| 4,430,069 | 2/1984 | Carlisle | 493/203 |
| 4,704,100 | 11/1987 | Kaufman | 493/194 |
| 4,706,439 | 11/1987 | Barton | 53/413 |
| 4,778,058 | 10/1988 | Yamazaki et al. | 206/610 |
| 4,956,893 | 9/1990 | Townsend | 17/34 |
| 4,967,541 | 11/1990 | Lakey | 53/550 |
| 4,997,504 | 3/1991 | Wood | 156/204 |
| 5,001,891 | 3/1991 | Abate | 53/551 |
| 5,052,166 | 10/1991 | Ziegler et al. | 53/433 |
| 5,109,654 | 5/1992 | Suga | 53/511 |
| 5,169,696 | 12/1992 | Lang et al. | 428/35.2 |
| 5,197,262 | 3/1993 | Katz et al. | 53/550 |
| 5,220,771 | 6/1993 | Burns | 53/551 |
| 5,328,021 | 7/1994 | Calvert et al. | 198/803.11 |

FOREIGN PATENT DOCUMENTS

| | | | |
|---|---|---|---|
| 0044395 | 1/1982 | European Pat. Off. | 53/450 |
| 1279010 | 9/1989 | Japan | 53/451 |
| 709966 | 6/1954 | United Kingdom | 53/550 |

*Primary Examiner*—Linda Johnson
*Assistant Examiner*—John Paradiso
*Attorney, Agent, or Firm*—Gerry S. Gressel; Larry L. Huston; E. Kelly Linman

[57] ABSTRACT

A packaging apparatus for sealing spaced groups of absorbent articles intermediate layers of a continuous wrapper is provided. The apparatus comprises a wrapper sealing apparatus for thermally bonding the layers; a wrapper seal cutting apparatus positioned downstream from the wrapper sealing apparatus for cutting the continuous wrapper to form individual packages of grouped absorbent articles; and a web support apparatus for preventing separation of the wrapper seals intermediate the wrapper sealing apparatus and the wrapper seal cutting apparatus. The web support apparatus comprises a plurality of wrapper support members supporting the wrapper layers intermediate the sealing apparatus and the cutting apparatus.

14 Claims, 3 Drawing Sheets

PACKAGING APPARATUS AND METHOD FOR PREVENTING SEPARATION OF PACKAGE SEALS

FIELD OF THE INVENTION

This invention is related to a packaging apparatus and packaging method. More particularly, the invention is related to a packaging apparatus and method for preventing separation of package seals formed by sealing spaced groups of absorbent articles intermediate layers of a wrapper film.

BACKGROUND OF THE INVENTION

Equipment for joining portions of a continuous web of material to form a package are known in the art. Such seals can be formed by pressing together layers of a continuous web (or webs) while heating the layers, thereby bonding the layers of the web together. U.S. Pat. No. 5,220,771 issued Jun. 22, 1993 to Burns discloses a tetrahedronal packaging machine for packaging liquids. Burns discloses heat sealing jaws mounted on an endless chain for forming package seals. U.S. Pat. No. 3,585,623 issued Jun. 15, 1971 to Laukaitis discloses an open circuit detector for a heating element. The heating elements form part of a conveyor element in a packaging machine. Conveyor chains are provided to carry the package forming conveyor elements. Each conveyor element can include a knife and a recess for accepting the knife. Each knife is periodically actuated to chop between parallel heat seals to separate package units from each other. The Laukaitis apparatus suffers from the complexity that a heating element and knife are included on each of several conveyor elements.

Equipment for spacing and advancing packages along a path is also known in the art. U.S. Pat. No. 5,328,021 issued Jul. 12, 1994 to Calvert et al. discloses adjustable flight bars for advancing packages in sequence along a path. The distance between adjacent flight bars can be varied to make the system adaptable for use with packages of different horizontal dimension. U.S. Pat. No. 3,959,952issued Jun. 1, 1976 to Deutschlander discloses a packaging apparatus using a hose shaped wrapper containing uniformly spaced groups of articles to be packaged. The apparatus has cooperating rotating welding shoes disposed in the path of travel of the wrapper for forming transverse seams in the wall portions of the wrapper between two article groups. Articles in each group of articles are shown standing edgewise. A plurality of pressing members are secured to endless chains. Each pressing member on one chain cooperates with a pressing member on the other chain for pinching together the wrapper prior to passage of the wrapper through the welding shoes. The pressing members thereby prevent leading or trailing articles from toppling over within the wrapper. Deutschlander teaches that toppling of the articles can prevent subsequent formation of the transverse seams in the wrapper. However Deutschlander does not recognize or address the problem of seal separation after the wrapper passes through the welding shoes.

Accordingly, those engaged in packaging research and development continue the search for effective packaging systems that are not overly complex, yet provide consistent package quality. The present invention recognizes the need for a relatively simple yet dependable packaging system for heat sealing spaced groups of articles intermediate layers of a continuous wrapper, while preventing separation of the package seals prior to cutting the continuous wrapper to form discrete sealed packages of the articles. In particular, the present invention recognizes that when packaging compressible stacks of absorbent articles between layers of heat bonded thermoplastic film, expansion of the stack of absorbent articles can separate the heat seals bonding the film layers together.

Accordingly, it is an object of the present invention to provide a method and apparatus for sealing spaced groups of absorbent articles intermediate layers of a continuous wrapper.

Another object of the present invention is to provide a method and apparatus for supporting layers of a continuous wrapper as the wrapper is carried intermediate a wrapper seal apparatus and a wrapper seal cutting apparatus to thereby prevent separation of the wrapper seals.

SUMMARY OF THE INVENTION

The present invention comprises a packaging apparatus for sealing spaced groups of absorbent articles intermediate layers of a continuous wrapper carried in a downstream machine direction path. The apparatus comprises a wrapper sealing apparatus for joining layers of the wrapper by thermally bonding the layers at spaced apart locations to form transverse heat seals intermediate the adjacent groups of absorbent articles; a wrapper seal cutting apparatus positioned downstream from the wrapper sealing apparatus for cutting the continuous wrapper to form individual packages of grouped absorbent articles; and a wrapper support apparatus for preventing separation of the wrapper seals intermediate the wrapper sealing apparatus and the wrapper seal cutting apparatus. The wrapper support apparatus comprises a plurality of wrapper support members for supporting the wrapper layers intermediate the sealing apparatus and the cutting apparatus. The wrapper support members are movable relative to the wrapper sealing apparatus and the wrapper seal cutting apparatus.

The wrapper support members can support the wrapper layers upstream of the wrapper sealing apparatus, and in one embodiment the wrapper support members continuously compressively support the wrapper layers intermediate the adjacent groups of absorbent articles from a position upstream of the wrapper sealing apparatus to a position downstream of the wrapper sealing apparatus. The wrapper support members can provide spacing of adjacent groups of the absorbent articles upstream of the wrapper sealing apparatus.

In one embodiment the wrapper support apparatus can include a first conveyor; a first plurality of wrapper support members carried by the first conveyor along the path of travel of the continuous wrapper; a second conveyor; and a second plurality of wrapper support members carried by the second conveyor along the path of travel of the continuous wrapper. Each support member on the first conveyor cooperates with a support member on the second conveyor to compressively support the wrapper layers intermediate adjacent groups of absorbent articles as the wrapper is carried intermediate the wrapper sealing apparatus and the wrapper seal cutting apparatus.

The present invention also comprises a method of forming individual packages of groups of absorbent articles sealed intermediate layers of a wrapper material. The method comprises the steps of:

providing a continuous wrapper;

providing spaced groups of absorbent articles disposed intermediate layers of the continuous wrapper;

conveying the continuous wrapper and the spaced groups of absorbent articles in a downstream machine direction path;

providing a wrapper sealing apparatus for thermally bonding layers of the wrapper at spaced apart locations intermediate adjacent groups of the absorbent articles to form seals intermediate the adjacent groups of absorbent articles;

providing a wrapper seal cutting apparatus positioned at a location spaced in a downstream machine direction from the wrapper sealing apparatus, the wrapper seal cutting apparatus for cutting the continuous wrapper to form individual packages of grouped absorbent articles disposed intermediate layers of the wrapper material;

providing a plurality of wrapper support members movable relative to the wrapper sealing apparatus and the wrapper seal cutting apparatus;

thermally bonding the wrapper layers intermediate adjacent groups of absorbent articles; and compressively supporting the wrapper layers with the wrapper support members intermediate the sealing apparatus and the cutting apparatus.

In one embodiment the method comprises the step of continuously supporting the wrapper layers with the wrapper support members from a position upstream of the wrapper sealing apparatus to a position downstream of wrapper sealing apparatus.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
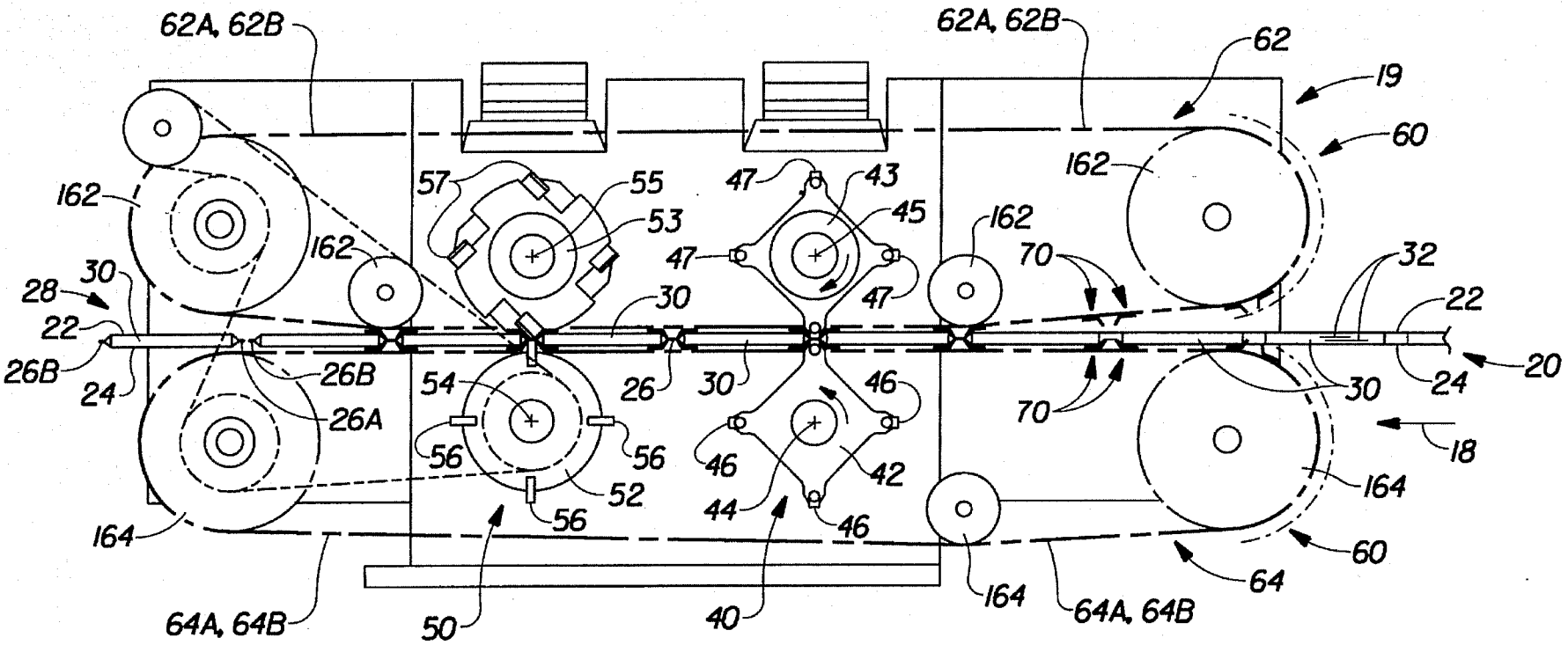
FIG. 1 is a schematic side view illustration of the packaging apparatus according to the present invention.

Referring to FIG. 1, a packaging apparatus 19 is shown for forming individual packages 28, each package formed by sealing a group 30 of absorbent articles 32 between layers 22 and 24 of a continuous wrapper 20. The packaging apparatus 19 receives the wrapper 20 and groups 30 of articles 32 as the wrapper 20 and groups 30 are conveyed in a downstream machine direction indicated by arrow 18.

Upstream of the packaging apparatus 19, the wrapper 20 can have the form of a continuous hose or tube. Methods for forming such a tube shaped wrapper are well known in the art. The layers 22 and 24 can comprise separate webs joined together along their side edges to form a tube like wrapper 20, or alternatively, the layers 22 and 24 can be formed from a single web by folding the web and joining the free side edges of the web. The layers 22 and 24 of the wrapper 20 can comprise a heat bondable polyolefinic film, such as a low density polyethylene film having a thickness of about 1 mil.

Upstream of the packaging apparatus 19 the groups 30 are disposed between the layers 22 and 24 of the wrapper 20, but are not separated one from the other by the wrapper 20. The packaging apparatus 19 comprises a wrapper sealing apparatus 40 for thermally joining together the layers 22 and 24 at transverse heat seals 26. The transverse heat seals 26 join together the layers 22 and 24 at spaced apart locations intermediate adjacent groups 30. The packaging apparatus 19 also includes a wrapper seal cutting apparatus 50 positioned at a location spaced in a downstream machine direction from the wrapper sealing apparatus 40. The wrapper seal cutting apparatus 50 cuts the wrapper 20 at spaced apart locations corresponding to the transverse seals 26 to form individual packages 28 having separate leading and trailing seal portions 26A and 26B.

After formation of the transverse heat seals 26, and prior to complete cooling of the heat seals 26, expansion of the resilient absorbent articles 32 within layers 22 and 24 of the wrapper 20 can cause separation of the heat seals 26. Such separation is undesirable because separated seals present a low quality appearance and can permit product contamination. Accordingly, the packaging apparatus 19 further includes a wrapper support apparatus 60 for preventing separation of the heat seals 26 intermediate the wrapper sealing apparatus 40 and the wrapper seal cutting apparatus 50. The web support apparatus 60 comprises a plurality of web support members 70. The web support members 70 support the wrapper layers 22 and 24 intermediate the wrapper sealing apparatus 40 and the wrapper seal cutting apparatus 50. In particular, the web support members 70 compressively support the wrapper layers 22 and 24 to prevent separation of the transverse heat seals 26 prior to their cooling, which separation can be caused by expansion of the groups 30 disposed between the layers 22 and 24.

Figure 4:
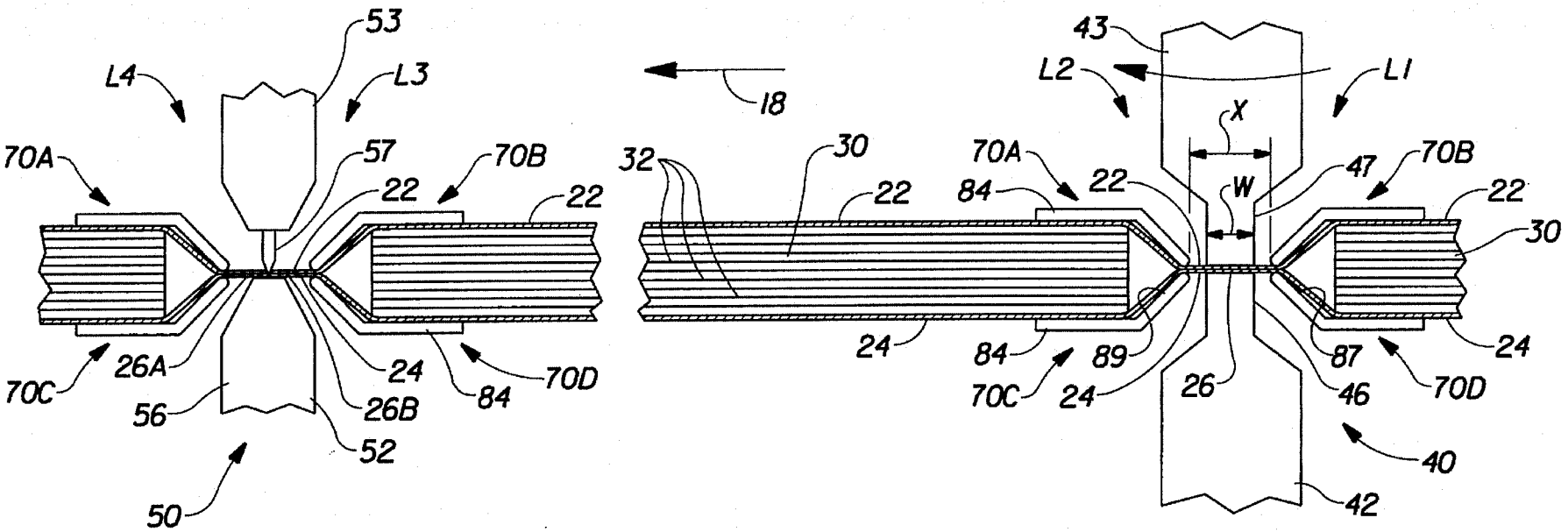
FIG. 4 is a schematic side view illustration of the packaging apparatus showing wrapper support members compressively supporting the wrapper layers intermediate sealing jaws and a seal cutting knife.

Referring to components of the packaging apparatus 19 in more detail, the wrapper sealing apparatus 40 can comprise first and second oppositely rotating members 42 and 43. Rotating members 42 and 43 rotate about spaced apart axes 44 and 45, respectively. Axis 45 is positioned above the machine direction path of travel of the wrapper 20, and axis 44 is positioned below the machine direction path of travel of the wrapper 20. Rotating member 42 has a plurality of heated sealing jaws 46 disposed about its circumference, and rotating member 43 has a plurality of heated sealing jaws 47 disposed about its circumference. The jaws 46 and 47 have a width W (FIG. 4). As the members 42 and 43 rotate, cooperating pairs of jaws 46 and 47 engage the wrapper 20 at spaced apart locations along the length of the wrapper 20 to form the transverse heat seals 26 intermediate adjacent groups 30 of absorbent articles 32. Heat sealing apparatus such as rotating sealing apparatus 40 are known by those skilled in the art. Alternatively, a heat sealing apparatus having reciprocating heat sealing jaws could be used.

The wrapper seal cutting apparatus 50 includes first and second rotating members 52 and 53, which rotate about axes 54 and 55, respectively. Axes 54 and 55 are disposed downstream of axes 44 and 45. Axis 54 is disposed below the path of travel of wrapper 20, and axis 55 is disposed above the path of travel of wrapper 20. Rotating member 53 has a plurality of knifes 57 disposed at spaced apart locations around its circumference. Rotating member 52 has a plurality of cutting anvils 56 disposed at spaced apart locations about its circumference. As the members 52 and 53 rotate, cooperating pairs of knifes 57 and anvils 56 engage the wrapper 20 about midway along the width of each transverse seal 26. The cooperating knife and anvil pairs cut the transverse seals heats 26 in about equal half portions 26A and 26B, thereby forming individual packages 28 having leading and trailing edge transverse seal portions 26A and 26B. Rotating cutting apparatus such as the rotating wrapper seal cutting apparatus 50 are known by those skilled in the art. Alternatively, a wrapper cutting apparatus having reciprocating knifes could be used.

The web support apparatus 60 can comprise a first conveyor 62 and a second conveyor 64. The first conveyor 62 can carry a first plurality of the wrapper support members 70 along a path of travel of the continuous wrapper 20. The second conveyor 64 can carry a second plurality of the wrapper support members 70 along the path of travel of the continuous wrapper 20, such that wrapper 20 is disposed between the first plurality of support members 70 on the conveyor 62 and the second plurality of support members 70 on the conveyor 64.

Figure 2:
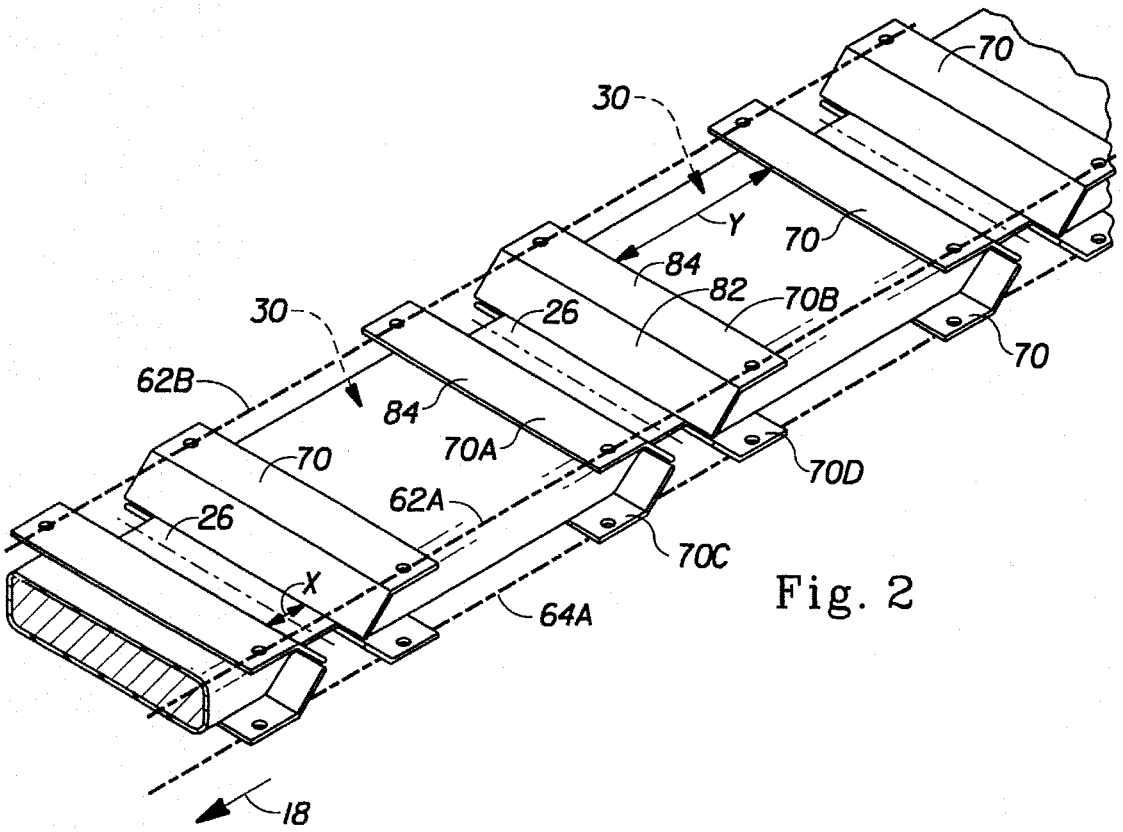
FIG. 2 is a perspective view of a portion of the packaging apparatus according to the present invention showing cooperating wrapper support members compressively supporting layers of a wrapper intermediate adjacent groups of absorbent articles disposed between the wrapper layers.
Figure 3:
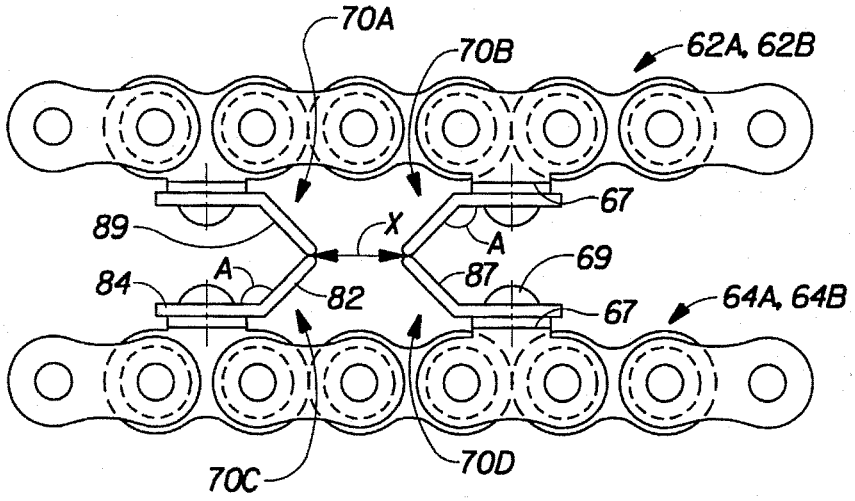
FIG. 3 is a side view illustration of a portion of first and second chain conveyors carrying web support members.

The conveyors 62 and 64 can comprise endless chains or belts. Referring to FIGS. 1–3, the conveyor 62 can comprise a pair of transversely spaced apart endless chains 62A and 62B (shown as dotted lines in FIG. 2 for clarity). Similarly, conveyor 64 can comprise a pair of transversely spaced apart endless chains 64A and 64B. The chains 62A, B are driven in a path around guide sprockets 162. The chains 64A, B are driven in a path around guide sprockets 164. One or more of the sprockets 162 and 164 are rotatably driven directly or indirectly by a motor, not shown. Movement of the chains 62A, B and 64A, B can be synchronized with rotation of the rotating members 42,43, 52, and 53 by any suitable means, including but not limited to timing chains, timing belts, or gear trains.

Each wrapper support member 70 carried by conveyor 62 is attached to and extends transversely intermediate chain 62A and chain 62B in rung like fashion, parallel to adjacent support members 70 carried by conveyor 62. Similarly, each wrapper support member 70 carried by conveyor 64 is attached to and extends transversely intermediate chains 64A and 64B in rung like fashion, parallel to adjacent support members 70 carried by conveyor 64. Each wrapper support member 70 can have a transversely extending first leg 82 and a transversely extending second leg 84 angled with respect to the first leg 82 to form an included angle A (FIG. 3) of between about 90 and 170 degrees. The wrapper support members 70 are rigidly attached to chain link lugs 67, such as by screws 69 extending through holes in the second legs 84.

Each wrapper support member 70 carried on the first conveyor 62 cooperates with a wrapper support member carried on the second to compressively support the wrapper layers 22 and 24 as the wrapper layers are carried intermediate the wrapper sealing apparatus 40 and the wrapper seal cutting apparatus 50. Referring to FIGS. 2 and 3, wrapper support member 70A on conveyor 62 cooperates with wrapper support member 70C on conveyor 64. In particular, the first legs 82 of cooperating support members 70 compressively support the wrapper layers 22, 24 intermediate adjacent groups 30 of absorbent articles 32. If desired, the second legs 84 of cooperating support members 70 can extend parallel to the machine direction to compressively support a portion of the wrapper layers 22, 24 overlying a group 30 of articles 32, thereby restricting expansion of the articles 32 between the layers 22 and 24.

The wrapper support members 70 are positioned on each of the conveyors 62 and 64 in pairs. For instance, wrapper support members 70A and 70B comprise a pair on conveyor 62, and wrapper support members 70C and 70D comprise a pair on conveyor 64. The spacing X (FIGS. 2 and 3) between paired support members 70 on a conveyor is less than the spacing Y between adjacent pairs of support members. The spacing X is sized to accommodate the sealing jaws 46, 47 of the wrapper sealing apparatus 40 and the knifes 57 of the seal cutting apparatus 50. Paired support members are attached to their respective conveyors such that their first legs 82 can extend in opposite directions from the conveyor. Referring to FIG. 4, a first set of cooperating support members 70B and 70D provide a generally upstream facing concave recess 87 for receiving and guiding the leading edge of a group 30 of articles 32, and an adjacent second set of cooperating support members 70A and 70C provide a generally downstream facing concave recess 89 for guiding the trailing edge of a preceding adjacent group of articles 32.

Upstream of the wrapper sealing apparatus 40, the paths of conveyors 62 and 64 converge in the downstream machine direction, as shown in FIG. 1. As the cooperating wrapper support members 70 on each of the conveyors come together along the converging path portions of the conveyors 62 and 64, the wrapper support members 70 provide machine direction spacing between adjacent groups 30 of articles 32 in the event the groups 30 have shifted between the layers 22 and 24 of the wrapper 20. Accordingly, the wrapper support members 70 ensure proper spacing between and position of adjacent groups 30 prior to formation of the transverse heat seals 26.

The web support members 70 first engage the wrapper layers 22 and 24 upstream of the wrapper sealing apparatus 40, and carry the wrapper layers 22, 24, and groups 30 through the wrapper sealing apparatus 40 and the wrapper seal cutting apparatus 50. The first legs 82 of cooperating support members 70 thereby provide continuous compressive support of the layers 22 and 24 from a position upstream of the wrapper sealing apparatus 40 to a position downstream of the wrapper seal cutting apparatus 50.

Referring to FIG. 4, first and second cooperating wrapper support members 70B and 70D compressively support the wrapper layers between the first and second wrapper support members 70B and 70D at a first location L1. This first location L1 is positioned upstream of the cooperating sealing jaws 46, 47. Simultaneously, third and fourth cooperating wrapper support members 70A and 70C compressively support the wrapper layers between the support members 70A and 70C at a second location L2 positioned downstream of the cooperating jaws 46, 47. The wrapper sealing apparatus 40 joins the wrapper layers at a location intermediate the first and second locations at which the wrapper layers are compressively supported. Subsequently, the first and second cooperating support members 70B and 70D compressively support the wrapper layers at a third location L3 downstream of L1 and L2, while simultaneously, the third and fourth cooperating support members 70A and 70C compressively support the wrapper layers at a fourth location L4 downstream of the third location L3. The wrapper seal cutting apparatus 50 cuts the wrapper seal 26 into seal portions 26A and 26B at a position intermediate the third and fourth locations.

While particular embodiments of the present invention have been illustrated and described, various changes and modifications can be made without departing from the spirit and scope of the invention. It is intended to cover, in the appended claims, all such modifications and intended uses.

What is claimed is:

1. A packaging apparatus for sealing spaced groups of articles intermediate layers of a continuous wrapper carded in downstream machine direction path, the apparatus comprising:

a wrapper sealing apparatus for thermally bonding layers of the wrapper at spaced apart locations intermediate adjacent groups of the articles to form seals intermediate the adjacent groups of articles;

a wrapper seal cutting apparatus positioned at a location spaced in a downstream machine direction from the wrapper sealing apparatus, the wrapper seal cutting apparatus for cutting the continuous wrapper to form individual packages of grouped articles disposed intermediate layers of the wrapper material; and a wrapper support apparatus for preventing separation of the wrapper seals intermediate the wrapper sealing apparatus and the wrapper seal cutting apparatus, the web support apparatus comprising a plurality of wrapper support members compressively supporting the wrapper layers as the wrapper layers are conveyed between a point upstream of the wrapper sealing apparatus and a point intermediate the wrapper sealing apparatus and the wrapper seal cutting apparatus, the wrapper support members movable relative to the wrapper sealing apparatus and the wrapper seal cutting apparatus;

wherein the wrapper support members compressively support the wrapper layers adjacent each seal at a first location upstream of the seal and at a second location downstream of each seal the first and second locations both being disposed intermediate adjacent groups of articles.

2. The apparatus of claim 1 wherein the wrapper support members support the wrapper layers downstream of the wrapper seal cutting apparatus.

3. The apparatus of claim 1 wherein the wrapper support members continuously compressively support the wrapper layers from a position upstream of the wrapper sealing apparatus to a position downstream of the wrapper sealing apparatus.

4. The apparatus of claim 3 wherein the wrapper support members provide spacing of adjacent groups of the articles upstream of the wrapper sealing apparatus.

5. The apparatus of claim 3 wherein the plurality of wrapper support members includes first and second cooperating wrapper support members and third and fourth cooperating wrapper support members, and wherein the first and second cooperating wrapper support members compressively support the wrapper layers between the first and second wrapper support members at the first location, wherein the third and fourth cooperating wrapper support members compressively support the wrapper layers at the second location positioned downstream of the first location, the first and second locations disposed intermediate adjacent groups of articles, and wherein the wrapper sealing apparatus joins the wrapper layers intermediate the first and third support members.

6. The apparatus of claim 5 wherein the first and second cooperating support members compressively support the wrapper layers at a third location downstream of the second location, wherein the third and fourth cooperating support members compressively support the wrapper layers at a fourth location downstream of the third location, and wherein the wrapper seal cutting apparatus severs the wrapper seal intermediate the first and third support members at a position intermediate the third and fourth locations.

7. The apparatus of claim 1 comprising:

a first conveyor;

a first plurality of wrapper support members carried by the first conveyor along the path of travel of the continuous wrapper;

a second conveyor; and a second plurality of wrapper support members carried by the second conveyor along the path of travel of the continuous wrapper, the wrapper disposed intermediate the first plurality of support members and the second plurality of support members;

wherein each support member carried by the first conveyor cooperates with a support member carried by the second conveyor to compressively support the wrapper layers as the wrapper layers are carried intermediate the wrapper sealing apparatus and the wrapper seal cutting apparatus.

8. The apparatus of claim 7 wherein the first plurality of wrapper support members are positioned on the first conveyor in pairs, and wherein the second plurality of wrapper support members are positioned on the second conveyor in pairs, and wherein the spacing between paired support members is less than the spacing between adjacent pairs of support members.

9. The apparatus of claim 8 wherein the wrapper sealing apparatus joins the wrapper layers intermediate paired support members.

10. The apparatus of claim 8 comprising a first set of cooperating wrapper support members providing a generally upstream facing concave recess, and an adjacent second set of cooperating support members providing a generally downstream facing concave recess.

11. The apparatus of claim 7 wherein each wrapper support member comprises a first leg, the first legs of cooperating wrapper support members for compressively supporting the wrapper intermediate adjacent groups of articles, and a second leg, the second leg angled with respect to the first leg.

12. A The apparatus of claim 11 wherein the second legs of cooperating wrapper support members compressively support a portion of the wrapper overlying a group of articles along at least a portion of the path of travel of the wrapper intermediate the wrapper sealing apparatus and the wrapper seal cutting apparatus.

13. A method of forming individual packages of groups of articles sealed intermediate layers of a wrapper material, the method comprising the steps of:

providing a continuous wrapper;

providing spaced groups of articles disposed intermediate layers of the continuous wrapper;

conveying the continuous wrapper and the spaced groups of absorbent articles in a downstream machine direction path;

providing a wrapper sealing apparatus for thermally bonding layers of the wrapper at spaced apart locations intermediate adjacent groups of the articles to form seals intermediate the adjacent groups of absorbent articles;

providing a wrapper seal cutting apparatus positioned at a location spaced in a downstream machine direction from the wrapper sealing apparatus, the wrapper seal cutting apparatus for cutting the continuous wrapper to form individual packages of grouped absorbent articles disposed intermediate layers of the wrapper material;

providing a plurality of cooperating wrapper support members movable between a point upstream of the wrapper sealing apparatus and a point between the wrapper sealing apparatus and the wrapper seal cutting apparatus;

thermally bonding the wrapper layers intermediate adjacent groups of articles to form a seal intermediate adjacent groups of articles;

cutting the wrapper intermediate adjacent groups of articles at a location downstream of the location where the wrapper layers are thermally bonded; and compressively supporting the wrapper layers adjacent each seal at a first location upstream of the seal and at a second location downstream of each seal as the wrapper layers and groups of articles are conveyed downstream, the first and second locations both being disposed intermediate adjacent groups of articles.

14. The method of claim 13 comprising the step of continuously supporting the wrapper layers with the wrapper support members from a position upstream of the wrapper sealing apparatus to a position downstream of the wrapper seal cutting apparatus.

* * * * *

UNITED STATES PATENT AND TRADEMARK OFFICE

CERTIFICATE OF CORRECTION

PATENT NO. : 5,537,802

DATED : July 23, 1996

INVENTOR(S) : Gary J. Omdorff

It is certified that error appears in the above-indentified patent and that said Letters Patent is hereby corrected as shown below:

Column 7, line 1 delete "carded" and insert --carried--.

Signed and Sealed this

Tenth Day of June, 1997

*Attest:*

Bruce Lehman

BRUCE LEHMAN

*Attesting Officer*

*Commissioner of Patents and Trademarks*